US006982059B2

(12) United States Patent
Liang et al.

(10) Patent No.: US 6,982,059 B2
(45) Date of Patent: Jan. 3, 2006

(54) RHODIUM, PLATINUM, PALLADIUM ALLOY

(75) Inventors: Jiang Liang, Schenectady, NY (US); Melvin Robert Jackson, Niskayuna, NY (US); Charles Gitahi Mukira, Clifton Park, NY (US); Mark Daniel Gorman, Westchester, OH (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/682,630

(22) Filed: Oct. 1, 2001

(65) Prior Publication Data

US 2005/0265888 A1 Dec. 1, 2005

(51) Int. Cl.
*C22C 5/04* (2006.01)

(52) U.S. Cl. ..... 420/467; 420/463; 420/462; 148/430

(58) Field of Classification Search ..... 420/466, 420/430, 462, 463, 467; 148/430
See application file for complete search history.

(56) References Cited

U.S. PATENT DOCUMENTS 3,622,310 A * 11/1971 Reinacher et al. ..... 420/466
3,640,705 A * 2/1972 Selman et al. ..... 420/466
3,779,728 A * 12/1973 Hansen et al. ..... 420/462
4,285,784 A * 8/1981 Flinn et al. ..... 205/83
6,071,470 A 6/2000 Koizumi et al.

* cited by examiner

*Primary Examiner*—Scott Kastler
(74) *Attorney, Agent, or Firm*—Paul J. DiConza; William E. Powell, III

(57) ABSTRACT

An alloy and a gas turbine engine component comprising an alloy are presented, with the alloy comprising:

palladium, in an amount ranging from about 1 atomic percent to about 41 atomic percent;

platinum, in an amount that is dependent upon the amount of palladium, such that a. for the amount of palladium ranging from about 1 atomic percent to about 14 atomic percent, the platinum is present up to about an amount defined by the formula (40+X) atomic percent, wherein X is the amount in atomic percent of the palladium, and b. for the amount of palladium ranging from about 15 atomic percent up to about 41 atomic percent, the platinum is present in an amount up to about 54 atomic percent; and the balance comprising rhodium, wherein the rhodium is present in an amount of at least 24 atomic percent;

wherein the alloy comprises a microstructure that is essentially free of L12-structured phase at a temperature greater than about 1000° C.

22 Claims, 4 Drawing Sheets

RHODIUM, PLATINUM, PALLADIUM ALLOY

BACKGROUND OF INVENTION

The present invention relates to materials designed to withstand high temperatures. More particularly, this invention relates to heat-resistant alloys for high-temperature applications, such as, for instance, gas turbine engine components of aircraft engines and power generation equipment.

There is a continuing demand in many industries, notably in the aircraft engine and power generation industries where efficiency directly relates to operating temperature, for alloys that exhibit sufficient levels of strength and oxidation resistance at increasingly higher temperatures. Gas turbine airfoils on such components as vanes and blades are usually made of materials known in the art as "superalloys." The term "superalloy" is usually intended to embrace iron-, cobalt-, or nickel-based alloys, which include one or more additional elements to enhance high temperature performance, including such non-limiting examples as aluminum, tungsten, molybdenum, titanium, and iron. The term "based" as used in, for example, "nickel-based superalloy" is widely accepted in the art to mean that the element upon which the alloy is "based" is the single largest elemental component by weight in the alloy composition. Generally recognized to have service capabilities limited to a temperature of about 1100° C., conventional superalloys used in gas turbine airfoils often operate at the upper limits of their practical service temperature range. In typical jet engines, for example, bulk average airfoil temperatures range between about 900° C. to about 1000° C., while airfoil leading and trailing edge and tip temperatures can reach about 1150° C. or more. At such elevated temperatures, the oxidation process consumes conventional superalloy parts, forming a weak, brittle metal oxide that is prone to chip or spall away from the part. Maximum temperatures are expected in future applications to be over about 1300° C., at which point many conventional superalloys begin to melt. Clearly, new materials must be developed if the efficiency enhancements available at higher operating temperatures are to be exploited.

The so-called "refractory superalloys," as described in Koizumi et al., U.S. Pat. No. 6,071,470, represent a class of alloys designed to operate at higher temperatures than those of conventional superalloys. According to Koizumi et al., refractory superalloys consist essentially of a primary constituent selected from the group consisting of iridium (Ir), rhodium (Rh), and a mixture thereof, and one or more additive elements selected from the group consisting of niobium (Nb), tantalum (Ta), hafnium (Hf), zirconium (Zr), uranium (U), vanadium (V), titanium (Ti), and aluminum (Al). The refractory superalloys have a microstructure containing an FCC (face-centered cubic)-type crystalline structure phase and an $L1_2$ type crystalline structure phase, and the one or more additive elements are present in a total amount within the range of from 2 atom % to 22 atom %.

SUMMARY OF INVENTION

Although the refractory superalloys have shown potential to become replacements for conventional superalloys in present and future gas turbine engine designs, it has been shown that many alloys of this class do not meet all of the desired performance criteria for high-temperature applications. Therefore, the need persists for alloys with improved high-temperature properties.

The present invention provides several embodiments that address this need. One embodiment is an alloy comprising palladium, in an amount ranging from about 1 atomic percent to about 41 atomic percent;

platinum, in an amount that is dependent upon the amount of palladium, such that a. for the amount of palladium ranging from about 1 atomic percent to about 14 atomic percent, the platinum is present up to about an amount defined by the formula (40+X) atomic percent, wherein X is the amount in atomic percent of the palladium, and b. for the amount of palladium ranging from about 15 atomic percent up to about 41 atomic percent, the platinum is present in an amount up to about 54 atomic percent; and the balance comprising rhodium, wherein the rhodium is present in an amount of at least 24 atomic percent;

wherein the alloy comprises a microstructure that is essentially free of L12-structured phase at a temperature greater than about 1000° C.

A second embodiment is an alloy comprising from about 5 atomic percent to about 40 atomic percent platinum and the balance comprising rhodium, wherein the alloy further comprises a microstructure that is essentially free of L12-structured phase at a temperature greater than about 1000° C.

A third embodiment is a gas turbine engine component comprising an alloy, the alloy comprising:

palladium, in an amount ranging from about 1 atomic percent to about 41 atomic percent;

platinum, in an amount that is dependent upon said amount of palladium, such that a. for said amount of palladium ranging from about 1 atomic percent to about 14 atomic percent, said platinum is present up to about an amount defined by the formula (40+X) atomic percent, wherein X is the amount in atomic percent of said palladium, and b. for said amount of palladium ranging from about 15 atomic percent up to about 41 atomic percent, said platinum is present in an amount up to about 54 atomic percent;

from about 0 atomic percent to about 5 atomic percent of a metal selected from the group consisting of zirconium, hafnium, titanium, and mixtures thereof;

from about 0 atomic percent to about 5 atomic percent ruthenium; and the balance comprising rhodium, wherein said rhodium is present in an amount of at least 24 atomic percent;

wherein said alloy of said gas turbine engine component further comprises a microstructure that is essentially free of L12-structured phase at a temperature greater than about 1000° C.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
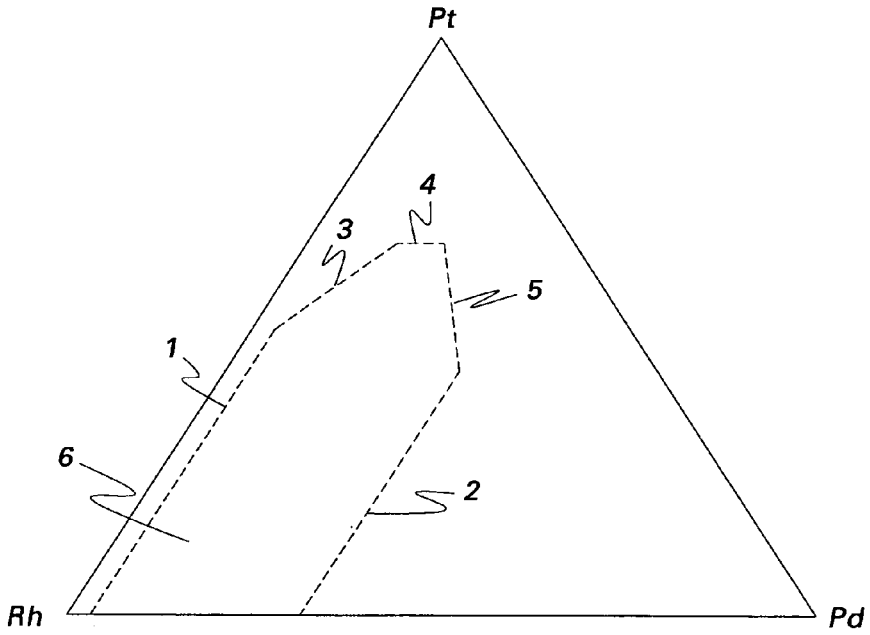
FIGS. 1–3 each depict a Pt—Rh—Pd ternary composition diagram.

The discussion herein employs examples taken from the gas turbine industry, particularly the portions of the gas turbine industry concerned with the design, manufacture, operation, and repair of aircraft engines and power generation turbines. However, the scope of the invention is not limited to only these specific industries, as the embodiments of the present invention are applicable to many and various applications that require materials resistant to high temperature and aggressive environments. Unless otherwise noted, the temperature range of interest where statements and comparisons are made concerning material properties is from about 1000° C. to about 1300° C. The term "high temperature" as used herein refers to temperatures above about 1000° C.

In several high temperature applications, such as, for example, gas turbines, the selection of structural materials is made based upon the performance of materials for a number of different properties. For gas turbine components, including, for example, turbine blades (also known as "buckets") and vanes (also known as "nozzles"), where the maximum metal temperatures typically range from about 1000° C. to over about 1200° C. in present systems and temperatures over about 1300° C. are envisioned for future applications, the properties that are considered include, for example, oxidation resistance, melting temperature (the temperature at which liquid metal begins to form as the material is heated), strength, coefficient of thermal expansion, modulus of elasticity, and cost.

The term "oxidation resistance" is used in the art to refer to the amount of damage sustained by a material when exposed to oxidizing environments, such as, for example, high temperature gases containing oxygen. Oxidation resistance is related to the rate at which the weight of a specimen changes per unit surface area during exposure at a given temperature. In many cases, the weight change is measured to be a net loss in weight as metal is converted to oxide that later detaches and falls away from the surface. In other cases, a specimen may gain weight if the oxide tends to adhere to the specimen, or if the oxide forms within the specimen, underneath the surface, a condition called "internal oxidation." A material is said to have "higher" or "greater" oxidation resistance than another if the material's rate of weight change per unit surface area is closer to zero than that of the other material for exposure to the same environment and temperature. Numerically, oxidation resistance can be represented by the time over which an oxidation test was run divided by the absolute value of the weight change per unit area.

"Strength" as used herein refers to the ultimate tensile strength of a material, which is defined in the art to mean the maximum load sustained by a specimen in a standard tensile test divided by the original cross-sectional area (i.e., the cross-sectional area of the specimen prior to applying the load).

Coefficient of thermal expansion ($\alpha$) is the change in unit length exhibited by a specimen of material per degree change in temperature. Modulus of elasticity (E) is the ratio of tensile stress divided by tensile strain for elastic deformation. These two quantities are considered in turbine material design and selection because the product of these two quantities is proportional to the amount of elastic stress generated between joined materials of differing thermal expansion coefficients. Therefore, to minimize stresses, the product of E and $\alpha$ (herein referred to as "E-alpha factor") is kept as low as possible.

Refractory superalloys, with their high content of highly environmentally resistant elements such as iridium and rhodium, represent a class of materials with potential for use in high temperature applications. However, as the data in Table 1 indicate, several refractory superalloys with compositions according to aforementioned U.S. Pat. No. 6,071,470 do not approach the oxidation resistance of a standard nickel-based superalloy at a temperature of about 1200° C.

TABLE 1

Oxidation resistance for selected alloys

| Alloy Designation (composition numbers refer to atomic percent) | Oxidation Resistance ($hr\text{-}cm^2/mg$) 100 hr. test at about 1200° C. |
|---|---|
| 1-A (Nickel-based superalloy) | 16.7 |
| 1-B (15Zr + bal. Ir) | 0.9 |
| 1-C (7Zr + bal. Rh) | 7.1 |
| 1-D (10Zr + 6Nb + bal. Rh) | 1.2 |

In refractory superalloy systems, oxidation resistance is primarily derived from the presence of certain metals selected from the so-called "platinum group" in the FCC phase. The platinum group comprises platinum (Pt), palladium (Pd), rhodium (Rh), iridium (Ir), rhenium (Re), ruthenium (Ru), and osmium (Os). Where the primary constituent of a refractory superalloy is rhodium, iridium, or mixtures thereof, strength is primarily derived by the addition of elements that promote the formation of the $L1_2$-structured phase. Because the $L1_2$-structured phase usually forms in these alloys by a precipitation mechanism from the supersaturated FCC ("matrix") phase, the elements that promote the formation of the $L1_2$-structured phase are referred to herein as "precipitate strengthening metals." Such metals include, for example, zirconium (Zr), niobium (Nb), tantalum (Ta), titanium (Ti), hafnium (Hf), and mixtures thereof. The $L1_2$-structured phase has a generic chemical formula of $M_3X$, where M is a platinum group metal and X is a precipitate strengthening metal. As the proportion of precipitate strengthening metal in the alloy increases, the volume fraction of $L1_2$-structured phase increases, which increases the strength of the alloy. However, as the volume fraction of $L1_2$-structured phase increases, the amount of platinum group metal present in the FCC matrix phase to provide oxidation resistance decreases—it is "tied up" in the $L1_2$-structured phase. Refractory superalloys, therefore, sacrifice a certain amount of oxidation resistance to enhance strength.

In contrast to the refractory superalloys of Koizumi et al., certain embodiments of the present invention are alloys that are essentially free of the $L1_2$-structured phase at a temperature greater than about 1000° C., and so the oxidation-resistant elements present are not significantly tied up in precipitate phases. The term "essentially free of the $L1_2$-structured phase" as used herein means that an alloy microstructure contains less than about 5 volume percent of the $L1_2$-structured phase. Formulation of alloys for high-temperature use is dependent upon an understanding of the property requirements needed for particular applications, and the relationship between alloy composition and properties. Some embodiments of the present invention represent a specific "window" of composition based upon such an understanding.

One embodiment of the present invention is an alloy comprising rhodium, platinum, and palladium, wherein the alloy comprises a microstructure that is essentially free of $L1_2$-structured phase at a temperature greater than about 1000° C. Some physical properties of these three elements, along with those of nickel (Ni) for comparison, are given in Table 2.

| Property | units | Rh | Pt | Pd | Ni |
|---|---|---|---|---|---|
| Melting Point | ° C. | 1966 | 1769 | 1552 | 1453 |
| Density | g/cc | 12.4 | 21.4 | 12 | 8.9 |
| Linear Expansion Coeff | $10^{-8}$/K | 8.3 | 9.1 | 11.6 | 13.3 |
| Young's Modulus | GPa | 414 | 171 | 117 | 207 |
| Tensile Strength | MPa | 758 | 138 | 228 | 827 |

Each of the elements platinum, palladium, and rhodium have a face-centered cubic (FCC) crystal structure, and are soluble in each other such that the FCC structure is maintained even when the three elements are mixed to form alloys. In terms of oxidation resistance, at a temperature of about 1300° C. and using the oxidation resistance of Pt as a baseline, Rh is about 2.5 times as resistant, and Pd is about 60% as resistant. By comparison, Ir is only about 2% as resistant as Pt at this temperature, and nickel-based superalloys are close to or past their incipient melting points (i.e., the lowest temperature at which localized melting of the alloy occurs) and thus are very susceptible to oxidation.

The alloy embodiments of the present invention represent formulations designed to balance the properties of the resulting alloy, by carefully controlling the alloy composition, such that the alloy has properties that are acceptable for use in a high temperature application, for example, a gas turbine engine. The formulation of such an alloy comprising Pt, Pd, and Rh represents an optimization driven by a series of compromises. For example, Pd is the least expensive element of the three, so an alloy that is relatively rich in Pd is less expensive than an alloy that is relatively lean in Pd. However, Pd also has the lowest oxidation resistance of the three elements, and so the advantageous cost of the Pd-rich alloys is offset by reduced oxidation resistance. Embodiments of the present invention have been formulated using an analysis of this and several other alloy property tradeoffs. The factors considered during the analysis included, for example, oxidation resistance, strength, cost, E-alpha factor, ease of alloy processing, reliability of joint between the alloy and a typical nickel-based superalloy (i.e., the ability to form a joint with acceptable strength and microstructure), and amount of diffusion interaction between the alloy and a nickel-based superalloy substrate. These last two factors are considered because in certain embodiments of the present invention, the alloy is in direct contact with gas turbine airfoil materials, such as, for example, nickel-based superalloys, and thus the reliability of the joint is one of several important factors. The amount of diffusion interaction with a nickel-based superalloy structure is also one of several important factors in these embodiments, where the amount of interaction is desired to be as low as possible to avoid significantly changing the local alloy chemistry at the interface between the alloy of the present invention and the nickel-based alloy. If such a change occurs, low-melting-point phases may form which will severely degrade the performance of the overall component. For the alloy of the present invention, one interaction that is considered potentially detrimental is that between palladium and nickel, where incorporation of 10 atomic percent Pd into nickel, for example, reduces the melting point by over 100° C. In addition, elements diffusing from the airfoil material into the alloy of the present invention will lower the inherent oxidation resistance of the alloy. Those skilled in the art will appreciate, therefore, that the need to mitigate the diffusion interaction property enhances the appeal of keeping the Pd concentration in the alloy as low as the combination of desired properties will allow.

In certain embodiments, the alloy of the present invention has an oxidation resistance of at least about 16 hour-cm2/mg at a temperature of about 1200° C., which is at least about as high as the oxidation resistance of the baseline nickel-based superalloy in Table 1. Certain embodiments are provided in which the alloy has an ultimate tensile strength greater than about 100 megapascals (MPa) at a temperature of about 1200° C., and in some embodiments, the alloy has an E-alpha factor less than about 3.6 MPa/° C. at a temperature of about 1000° C.

Certain embodiments of the present invention provide that the alloy of the present invention further comprises a metal selected from the group consisting of zirconium, hafnium, titanium, and mixtures thereof, and in some embodiments, the alloy comprises from about 0 atomic percent to about 5 atomic percent of a metal selected from the group consisting of zirconium, hafnium, titanium, and mixtures thereof, herein referred to as "strengtheners". Particular embodiments provide that the metal comprises zirconium. In the alloys of the present invention, these elements serve to improve alloy strength, but not by forming the $L1_2$-structured phase of the refractory superalloys. The amount of strengtheners added to the alloys of the present invention is controlled to be below the solubility limit at about 1000° C. for these elements in the FCC Pt—Rh—Pd solid solution. Controlling the amount of strengtheners in this way ensures that the alloys of the present invention remain essentially free of $L1_2$-structured phase at a temperature greater than about 1000° C. The strengthening is instead achieved through solid solution strengthening, wherein the strengthening element remains dissolved in the FCC phase and hardens the FCC phase by straining the surrounding FCC crystal structure. Additionally, as an alloy of the present invention comprising strengtheners is exposed to high-temperature service conditions, the strengtheners oxidize to form a uniform dispersion of very small, very hard oxide particles that reinforce the FCC alloy.

In some embodiments, the alloy of the present invention further comprises from about 0 atomic percent to about 5 atomic percent ruthenium. This element has been found to enhance the ability of high temperature alloys to resist both internal and external oxidation, when present in an amount consistent with the above composition range.

Referring to FIG. 1 (a Pt—Rh—Pd ternary composition diagram), in certain embodiments of the alloy of the present invention, the Pd is present in an amount ranging from about 1 atomic percent (composition boundary 1) to about 41 atomic percent (composition boundary 2); the Pt is present in an amount that is dependent upon the amount of palladium, such that a. for the amount of palladium ranging from about 1 atomic percent to about 14 atomic percent, the platinum is present up to about an amount defined by the formula (40+X) atomic percent (composition boundary 3), wherein X is the amount in atomic percent of the palladium, and b. for the amount of palladium ranging from about 15 atomic percent up to about 41 atomic percent, the platinum is present in an amount up to about 54 atomic percent (composition boundary 4); and the balance comprising rhodium, wherein the rhodium is present in an amount of at least 24 atomic percent (composition boundary 5). The alloys according to the above embodiment are therefore contained in the composition field 6 as shown in FIG. 1.

Figure 2:
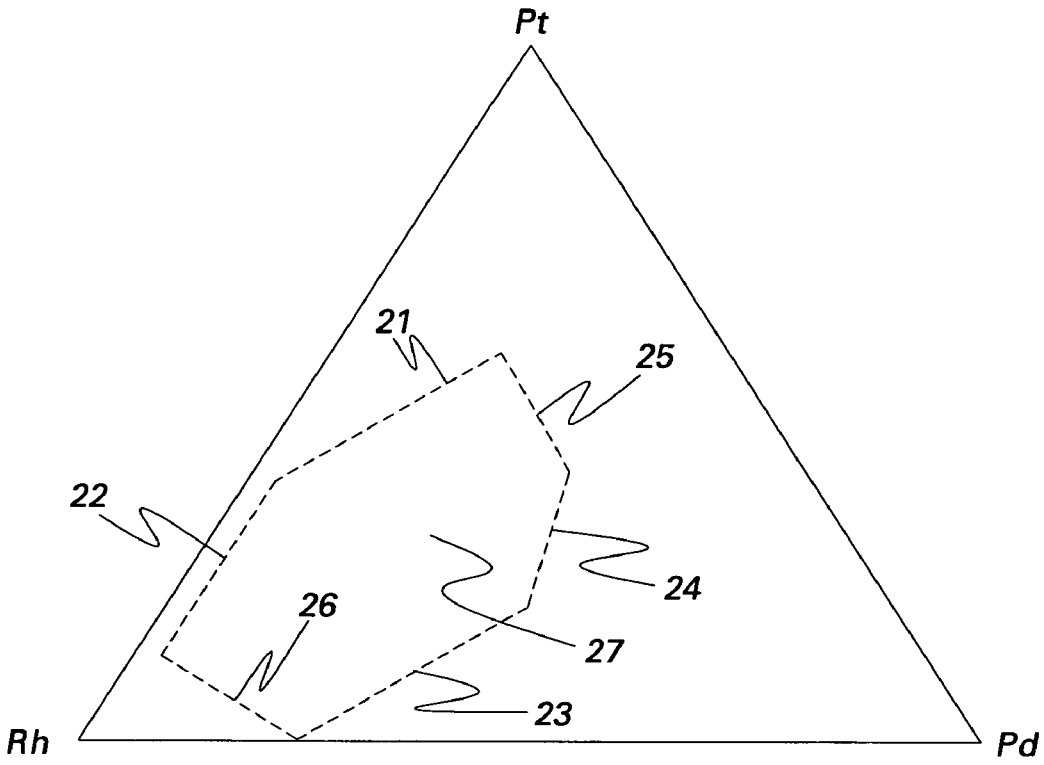

Referring to FIG. 2, in particular embodiments the platinum is present up to the lesser of about 52 atomic percent and an amount defined by the formula (30+X) atomic percent (composition boundary 21), wherein X is the amount of the palladium; the palladium is present in an amount that is dependent on the amount of the platinum, such that a. for the amount of platinum ranging from about 0 to about 21 atomic percent, the palladium is present in an amount ranging from about 1 atomic percent (composition boundary 22) to about an amount defined by the formula (15+Y) atomic percent (composition boundary 23), wherein Y is the amount in atomic percent of the platinum, and b. for the amount of platinum ranging from about 22 atomic percent to about 52 atomic percent, the palladium is present in an amount ranging from about 1 atomic percent (composition boundary 22) to about 36 atomic percent (composition boundary 24); and the balance comprises rhodium, wherein the rhodium is present in an amount ranging from about 26 atomic percent (composition boundary 25) to the lesser of about 95 atomic percent and about an amount defined by the formula (85+2Y) atomic percent (composition boundary 26), wherein Y is the amount in atomic percent of the platinum. The alloys according to the above embodiment are therefore contained in the composition field 27 as shown in FIG. 2.

Figure 3:
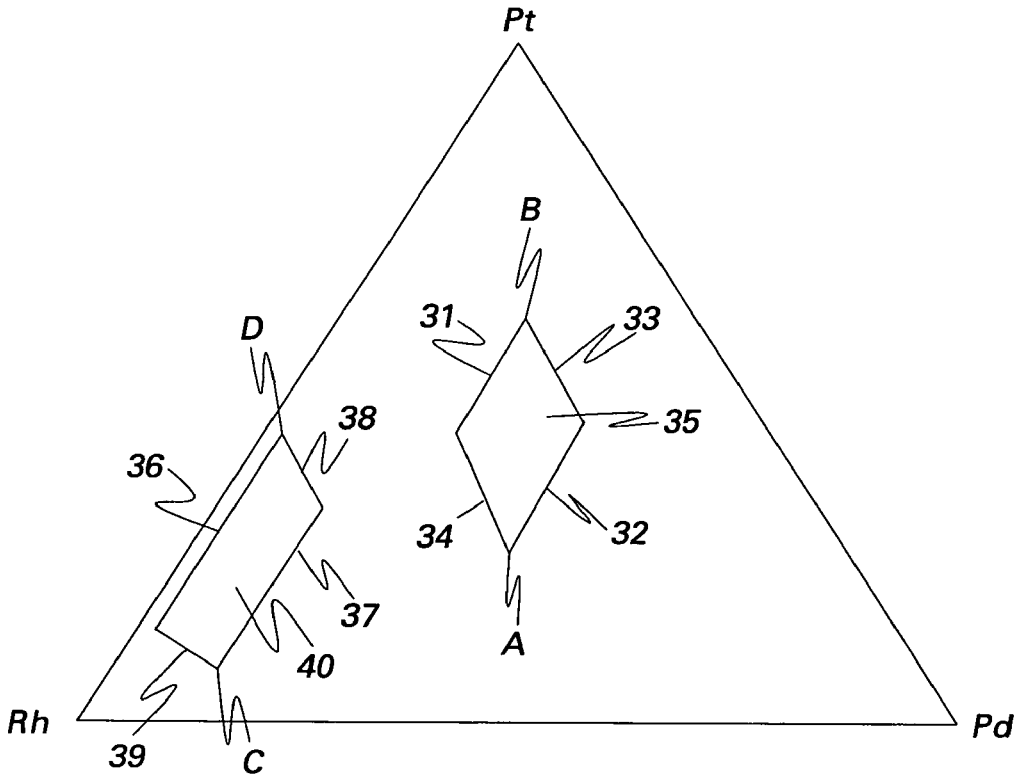

Referring to FIG. 3, in particular embodiments, the alloy of the present invention comprises from about 21 atomic percent platinum (point A) to about 52 atomic percent platinum (point B); from about 22 atomic percent palladium (composition boundary 31) to about 36 atomic percent palladium (composition boundary 32); and the balance comprises rhodium, wherein the rhodium is present in an amount ranging from about 26 atomic percent rhodium (composition boundary 33) to about 43 percent rhodium (composition boundary 34). The alloys according to the above embodiment are therefore contained in the composition field 35 as shown in FIG. 3.

In other particular embodiments, the alloy of the present invention comprises from about 3 atomic percent platinum (point C) to about 29 atomic percent platinum (point D); from about 1 atomic percent palladium (composition boundary 36) to about 6 atomic percent palladium (composition boundary 37); and the balance comprises rhodium, wherein the rhodium is present in an amount ranging from about 70 atomic percent (composition boundary 38) to the lesser of about 94 atomic percent and about an amount defined by the formula (85+2Y) atomic percent (composition boundary 39), wherein Y is the amount in atomic percent of the platinum. The alloys according to the above embodiment are therefore contained in the composition field 40 as shown in FIG. 3.

The alloys of composition field 35 are comparatively rich in Pd and lean in Rh when compared to the alloys of composition field 40. The alloys of composition field 35 are optimized compositions wherein factors such as, for example, cost and ductility are weighted more heavily than for the alloys of composition field 40 in an optimization analysis. The alloys of composition field 40 are optimized compositions wherein oxidation resistance is weighted comparatively heavily in an optimization analysis. It will be appreciated by those skilled in the art, therefore, that alloys of composition field 40 are, for example, more oxidation resistant, more expensive, and less ductile than the alloys of composition field 35, and that the selection of any particular alloy composition is done based upon the particular requirements of the application for which the alloy is being selected.

Referring again to FIG. 1, in particular embodiments, the alloy of the present invention consists essentially of palladium, in an amount ranging from about 1 atomic percent (composition boundary 1) to about 41 atomic percent (composition boundary 2); platinum, in an amount that is dependent upon the amount of palladium, such that a. for the amount of palladium ranging from about 1 atomic percent to about 14 atomic percent, the platinum is present up to about an amount defined by the formula (40+X) atomic percent (composition boundary 3), wherein X is the amount in atomic percent of the palladium, and b. for the amount of palladium ranging from about 15 atomic percent up to about 41 atomic percent, the platinum is present in an amount up to about 54 atomic percent (composition boundary 4);

from about 0 atomic percent to about 5 atomic percent of a metal selected from the group consisting of zirconium, hafnium, titanium, and mixtures thereof;

from about 0 atomic percent to about 5 atomic percent ruthenium; and the balance rhodium, wherein the rhodium is present in an amount of at least 24 atomic percent (composition boundary 5); wherein the alloy further comprises a microstructure that is essentially free of $L1_2$-structured phase at a temperature greater than about 1000° C.

Those skilled in the art will appreciate that additions of carbon and boron to the embodiments of the present invention may marginally improve strength and other properties as they do in many other alloy systems, and that such additions are generally up to about 0.25 atomic percent for each of these two elements. Furthermore, incidental impurities, such as nickel, cobalt, chromium, iron, and other metals, are often present in processed alloys and may be present in alloys provided by the present invention in amounts of up to about 0.5 atomic percent, for example.

Other embodiments of the present invention provide an alloy comprising from about 5 atomic percent to about 40 atomic percent platinum and the balance comprising rhodium (herein referred to as a "Rh—Pt alloy"), wherein the alloy further comprises a microstructure that is essentially free of $L1_2$-structured phase at a temperature greater than about 1000° C. The alternatives for properties and the presence of strengtheners and ruthenium, as described for above embodiments, are also applicable to this embodiment. In certain embodiments, the alloy comprises from about 5 atomic percent to about 30 atomic percent platinum and the balance comprises rhodium, and in particular embodiments, the alloy comprises from about 5 atomic percent to about 10 atomic percent platinum; and the balance comprises rhodium. Certain embodiments provide an alloy consisting essentially of from about 5 atomic percent to about 40 atomic percent platinum; from about 0 atomic percent to about 5 atomic percent of a metal selected from the group consisting of zirconium, hafnium, titanium, and mixtures thereof; from about 0 atomic percent to about 5 atomic percent ruthenium; and the balance rhodium; wherein said alloy comprises a microstructure that is essentially free of $L1_2$-structured phase at a temperature greater than about 1000° C. The Rh—Pt alloy compositions described are optimized to provide a high level of oxidation resistance and strength, suitable for use in a high-temperature application, for example, a gas turbine engine component.

Another embodiment of the present invention provides a gas turbine engine component comprising the alloy of the present invention. The alternatives for composition and properties of the alloy in these gas turbine engine component embodiments are the same as discussed above for the alloy embodiments.

Figure 4:
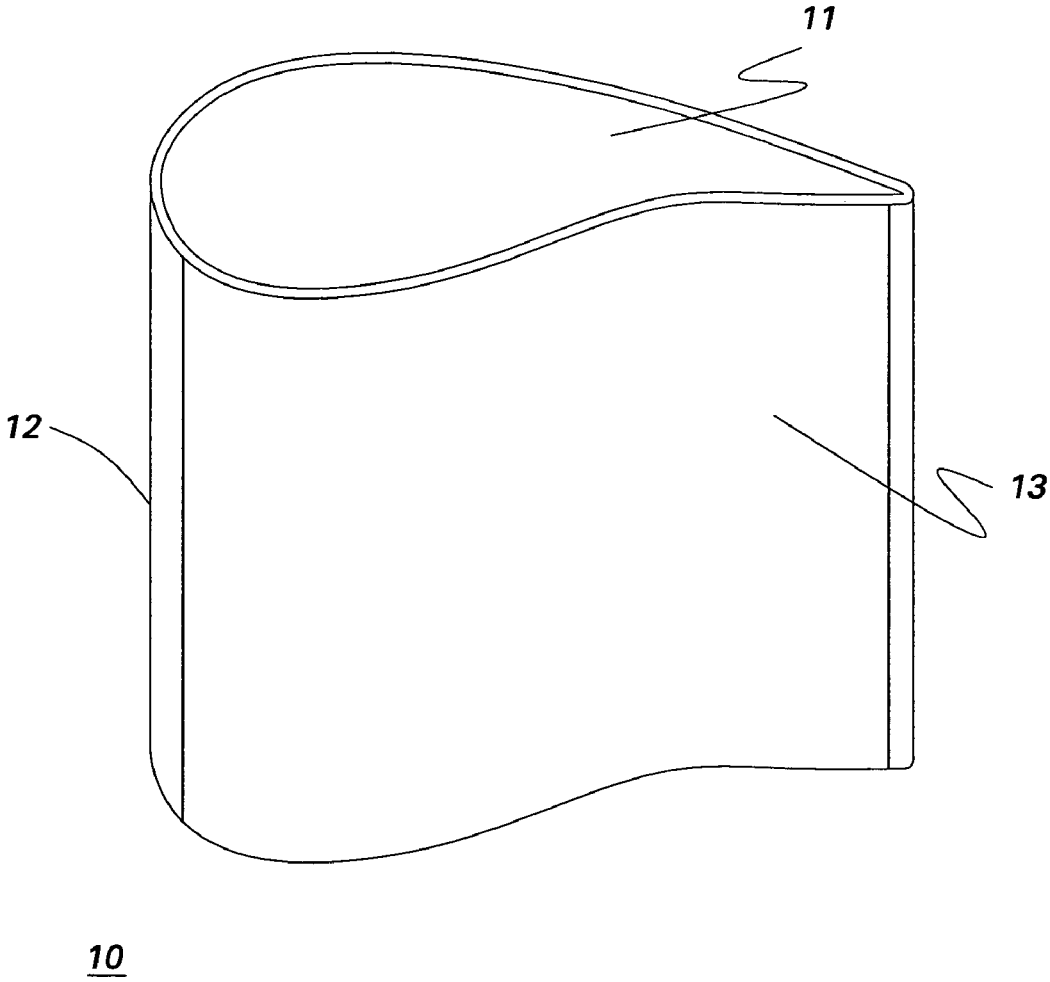
FIG. 4 is a schematic representation of an airfoil.

In some embodiments, the gas turbine engine component is a blade of an aircraft engine, a vane of an aircraft engine, a bucket of a power generation turbine engine, or a nozzle of a power generation turbine. Referring to FIG. 4, in particular embodiments the gas turbine engine component comprises an airfoil 10, and the airfoil comprises the alloy. Specific embodiments provide that the airfoil 10 comprises a tip section 11, a leading edge section 12, and a trailing edge section 13, and wherein at least one of said tip section 11, said leading edge section 12, and said trailing edge section 13 comprises said alloy. Having only particular sections (i.e., those sections known to experience the most aggressive stress-temperature combinations) of the airfoil comprise the alloy of the present invention minimizes certain drawbacks of alloys comprising significant amounts of rhodium, platinum, or palladium, including their high cost and high density in comparison to conventional airfoil materials. These drawbacks have a reduced effect on the overall component because the rhodium-based high temperature alloy comprises only a fraction of the overall surface area of the component. The properties of the component are thus "tailored" to the expected localized environments, reducing the need for compromise during the design process and increasing the expected operating lifetimes for new and repaired components. As described above, E-alpha factor and diffusion interaction are considered to be two of several important factors in the selection of a suitable alloy for embodiments where the alloy is to comprise only particular sections of a gas turbine component, because the alloy is to be in direct contact with a nickel-based alloy as in, for example, a coating or a brazed or welded joint.

Alloys set forth herein as embodiments of the present invention are made using any of the various traditional methods of metal production and forming. Traditional casting, powder metallurgical processing, directional solidification, and single-crystal solidification are non-limiting examples of methods suitable for forming ingots of these alloys. Thermal and thermo-mechanical processing techniques common in the art for the formation of other alloys are suitable for use in manufacturing and strengthening the alloys of the present invention. For embodiments where the alloy of the present invention comprises strengtheners, the alloy may be given a heat-treatment in air at a temperature suitable to form a dispersion of oxide particles as described above. For situations where alloys of the present invention are joined to a Ni-base superalloy or other conventional material, heat treatments are limited to temperatures below those that will degrade or melt the conventional material.

The examples presented below are intended to demonstrate results obtained with alloys of the present invention and are not to be considered as limiting the scope of the present invention in any way.

EXAMPLE 1

Several alloys with compositions according to embodiments of the present invention were prepared for an oxidation test to be run for 100 hours at a temperature of about 1300° C. The tested compositions are presented in Table 3. The test specimens were cylindrical pins with a diameter of about 2.5 mm and length of about 30 mm. After exposure, the diameter of each pin was measured and the change in radius was used as a measure of oxidation resistance. Each of the alloys tested registered a radius change of less than about 0.003 mm. For comparison, a similar specimen of a single crystal nickel-based superalloy, tested at a significantly lower temperature (about 1200° C.) to avoid incipient melting, registered a radius change of about 0.03 mm.

| Designation | Composition (numbers represent atomic percent) |
|---|---|
| A | 60Rh—20Pt—20Pd |
| B | 60Rh—25Pd—10Pt—2Ru—3Zr |
| C | 40Rh—34.5Pt—25Pd—0.5Zr |

EXAMPLE 2

Alloys designated A and B in Table 3, above, were tested for ultimate tensile strength at about 1200° C., along with a specimen of a single crystal nickel-based superalloy. The ultimate tensile strength results were as follows: Nickel-based alloy, 152 MPa; Alloy A, 124 MPa; Alloy B, 152 MPa.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An alloy for use in high-temperature applications, said alloy comprising:

palladium, in an amount ranging from about 1 atomic percent to about 41 atomic percent;

platinum, in an amount that is dependent upon said amount of palladium, such that a. for said amount of palladium ranging from about 1 atomic percent to about 14 atomic percent, said platinum is present up to about an amount defined by the formula (40+X) atomic percent, wherein X is the amount in atomic percent of said palladium, and b. for said amount of palladium ranging from about 15 atomic percent up to about 41 atomic percent, said platinum is present in an amount up to about 54 atomic percent; and the balance comprising rhodium, wherein said rhodium is present in an amount of at least 24 atomic percent;

wherein said alloy is essentially free of L12-structured phase at a temperature greater than about 1000° C.

2. The alloy of claim 1, wherein said alloy further comprises a metal selected from the group consisting of zirconium, hafnium, titanium, and mixtures thereof.

3. The alloy of claim 1, wherein said alloy comprises from about 0 atomic percent to about 5 atomic percent of a metal selected from the group consisting of zirconium, hafnium, titanium, and mixtures thereof.

4. The alloy of claim 3, wherein said metal comprises zirconium.

5. The alloy of claim 3, further comprising from about 0 atomic percent to about 5 atomic percent ruthenium.

6. The alloy of claim 5, wherein:

said platinum is present up to the lesser of about 52 atomic percent and an amount defined by the formula (30+X) atomic percent wherein X is the amount of said palladium;

said palladium is present in an amount that is dependent on the amount of said platinum, such that a. for said amount of platinum ranging from about 0 to about 21 atomic percent, said palladium is present in an amount ranging from about 1 atomic percent to about an amount defined by the formula (15+Y) atomic percent, wherein Y is the amount in atomic percent of said platinum, and b. for said amount of platinum ranging from about 22 atomic percent to about 52 atomic percent, said palladium is present in an amount ranging from about 1 atomic percent to about 36 atomic percent; and the balance comprising rhodium, wherein said rhodium is present in an amount ranging from about 26 atomic percent to the lesser of about 95 atomic percent and about an amount defined by the formula (85+2Y) atomic percent, wherein Y Is the amount in atomic percent of said platinum.

7. The alloy of claim 6, said alloy comprising:

from about 21 atomic percent platinum to about 52 atomic percent platinum, from about 22 atomic percent palladium to about 36 atomic percent palladium; and the balance comprising rhodium, wherein said rhodium is present in an amount ranging from about 26 atomic percent rhodium to about 43 atomic percent rhodium.

8. The alloy of claim 6, said alloy composing:

from about 3 atomic percent platinum to about 29 atomic percent platinum;

from about 1 atomic percent palladium to about 6 atomic percent palladium; and the balance comprising rhodium, wherein said rhodium is present in an amount ranging from about 70 atomic percent to the lesser of about 94 atomic percent and about an amount defined by the formula (85+2Y) atomic percent, wherein Y Is the amount in atomic percent of the platinum.

9. An alloy consisting essentially of:

palladium, in an amount ranging from about 1 atomic percent to about 41 atomic percent;

platinum, in an amount that is dependent upon said amount of palladium, such that a. for said amount of palladium ranging from about 1 atomic percent to about 14 atomic percent, said platinum is present up to about an amount defined by the formula (40+X) atomic percent, wherein X is the amount in atomic percent of said palladium, and b. for said amount of palladium ranging from about 15 atomic percent up to about 41 atomic percent, said platinum is present in an amount up to about 54 atomic percent;

from about 0 atomic percent to about 5 atomic percent of a metal selected from the group consisting of zirconium, hafnium, titanium, and mixtures thereof;

from about 0 atomic percent to about 5 atomic percent ruthenium; and the balance rhodium, wherein said rhodium is present in an amount of at least 24 atomic percent;

wherein said alloy is essentially free of L12-structured phase at a temperature greater than about 1000° C.

10. An alloy comprising:

from about 5 atomic percent to about 40 atomic percent platinum;

a metal selected from the group consisting of zirconium, hafnium, titanium, and mixtures thereof; and the balance comprising rhodium;

wherein said alloy is essentially free of L12-structured phase at a temperature greater than about 1000° C.

11. The alloy of claim 10, wherein said alloy comprises from about 0 atomic percent to about 5 atomic percent of a metal selected from the group consisting of zirconium, hafnium, titanium, and mixtures thereof.

12. The alloy of claim 11, wherein said metal comprises zirconium.

13. The alloy of claim 11, further comprising from about O atomic percent to about 5 atomic percent ruthenium.

14. The alloy of claim 13, comprising:

from about 5 atomic percent to about 30 atomic percent platinum; and the balance comprising rhodium.

15. The alloy of claim 14, comprising:

from about 5 atomic percent to about 10 atomic percent platinum; and the balance comprising rhodium.

16. A gas turbine engine component comprising an alloy, said alloy comprising:

palladium, in an amount ranging from about 1 atomic percent to about 41 atomic percent;

platinum, in an amount that is dependent upon said amount of palladium, such that a. for said amount of palladium ranging from about 1 atomic percent to about 14 atomic percent, said platinum is present up to about an amount defined by the formula (40+X) atomic percent, wherein X is the amount in atomic percent of said palladium, and b. for said amount of palladium ranging from about 15 atomic percent up to about 41 atomic percent, said platinum is present in an amount up to about 54 atomic percent;

from about 0 atomic percent to about 5 atomic percent of a metal selected from the group consisting of zirconium, hafnium, titanium, and mixtures thereof;

from about 0 atomic percent to about 5 atomic percent ruthenium; and the balance comprising rhodium, wherein said rhodium is present in an amount of at least 24 atomic percent;

wherein said alloy of said gas turbine engine component essentially free of L12-structured phase at a temperature greater than about 1000° C.

17. The turbine engine component of claim 16, wherein said gas turbine engine component is a blade of an aircraft engine, a vane of an aircraft engine, a bucket of a power generation turbine engine, or a nozzle of a power generation turbine.

18. The turbine engine component of claim 17, wherein said gas turbine engine component comprises an airfoil, and wherein said airfoil comprises said alloy.

19. The turbine engine component of claim 18, wherein said airfoil comprises a tip section, a leading edge section, and a trailing edge section, and wherein at least one of said tip section, said leading edge section, and said trailing edge section comprises said alloy.

20. A turbine engine airfoil comprising an alloy, said alloy comprising:

from about 21 atomic percent to about 52 atomic percent platinum;

from about 22 atomic percent to about 36 atomic percent palladium; and the balance comprising rhodium, wherein said rhodium is present in an amount ranging from about 26 atomic percent to about 43 atomic percent rhodium, wherein said alloy of said turbine engine airfoil is essentially free of L12-structured phase at a temperature greater than about 1000° C.

21. A turbine engine airfoil comprising an alloy, said alloy comprising:

from about 5 atomic percent to about 30 atomic percent platinum;

from about 1 atomic percent to about 6 atomic percent palladium; and the balance comprising rhodium, wherein said rhodium is present in an amount ranging from about 70 atomic percent to the lesser of about 94 atomic percent and about an amount; defined by the formula (85+2Y) atomic percent, wherein Y is the amount in atomic percent of the platinum;

wherein said alloy of said turbine engine airfoil is essentially free of L12-structured phase at a temperature greater than about 1000° C.

22. A turbine engine airfoil comprising an alloy, said alloy comprising:

from about 5 atomic percent to about 40 atomic percent platinum;

from about 0 atomic percent to about 5 atomic percent of a metal selected from the group consisting of zirconium, hafnium, titanium, and mixtures thereof;

from about 0 atomic percent to about 5 atomic percent ruthenium; and the balance comprising rhodium:

wherein said alloy of said turbine engine airfoil is essentially free of L12-structured phase at a temperature greater than about 1000° C.

* * * * *